United States Patent [19]

Cohen

[11] Patent Number: 4,682,697

[45] Date of Patent: Jul. 28, 1987

[54] CARPET SAMPLE DISPLAY DEVICE

[76] Inventor: Melvin Cohen, 2 Brighton Ave., Passaic, N.J. 07055

[21] Appl. No.: 866,692

[22] Filed: May 27, 1986

[51] Int. Cl.[4] ..... A47F 7/16

[52] U.S. Cl. ..... 211/45; 211/101; 211/133

[58] Field of Search ..... 211/45, 47, 48, 13, 211/10, 52, 55, 41, 71, 126, 128, 133, 181

[56] References Cited

U.S. PATENT DOCUMENTS

| | | | |
|---|---|---|---|
| De. 191,082 | 8/1961 | Tigner | 211/181 X |
| 575,590 | 1/1897 | Brightman | 211/181 X |
| 752,368 | 2/1904 | Whitcomb | 211/181 X |
| 1,514,375 | 11/1924 | Crimmel | 211/181 X |
| 2,194,802 | 3/1940 | Low | 211/128 X |
| 2,643,774 | 6/1953 | Patterson et al. . | |
| 2,879,898 | 3/1959 | Best . | |
| 2,946,454 | 7/1960 | Asher . | |
| 2,964,198 | 12/1960 | Eisbart . | |
| 3,195,733 | 7/1965 | Best . | |
| 3,534,863 | 10/1970 | Howard | 211/47 |
| 3,570,679 | 3/1971 | Edson | 211/47 |
| 3,633,759 | 1/1972 | Jennings . | |
| 4,038,767 | 8/1977 | Chasin et al. . | |
| 4,232,791 | 11/1980 | Howard | 211/47 |
| 4,331,245 | 5/1982 | Schell | 211/45 |
| 4,427,118 | 1/1984 | Carrigan et al. . | |
| 4,446,974 | 5/1984 | Ott . | |
| 4,604,061 | 8/1986 | Willcocks et al. | 211/45 X |

*Primary Examiner*—Robert W. Gibson, Jr.
*Assistant Examiner*—Sarah A. Lechok Eley
*Attorney, Agent, or Firm*—Siegmar Silber

[57] ABSTRACT

A display device for a plurality of carpet samples is provided having a base; a rectangular frame slopingly mounted in the top portion of the base, the frame having a back frame member, a front frame member, and a pair of side frame members, the back frame member when assembled thereto, being elevated substantially above the front frame member;

a plurality of bottom support rails interconnecting the medial portions of the front and the back frame members the bottom support rails having a rear portion descend substantially vertically from the back frame member, having a middle portion disposed substantially parallel to the side frame members, and having a front portion extending horizontally to the front frame member; and, a plurality of sample-holding compartments mounted thereon, each compartment forming a pigeonhole for one of the carpet samples with the samples being arrayed in a waterfall display.

In the display device, each carpet sample is housed in a compartment and has a displayed edge portion which protrudes beyond the end of the adjacent carpet sample in the adjacent rearward compartment.

13 Claims, 4 Drawing Figures

CARPET SAMPLE DISPLAY DEVICE

BACKGROUND OF THE INVENTION

1. Field of the Invention

This invention relates to improvements in a carpet sample display rack for displaying carpet samples to the public, and more particularly to a rack allowing easy removability of individual carpet samples. With the display rack of this invention, a waterfall array of samples is accomplished without requiring the installation of hangers, rods, or other support devices on the carpet samples.

2. Disclosure Information Statement

In preparation for this application, a pre-examination patentability search was conducted. The search was conducted in Class 211/44, 45, 47 and 182. The search uncovered the following patents:

| Patent No. | Inventor | Date of Issue |
|---|---|---|
| 4,446,974 | Ott | May 8, 1984 |
| 4,427,118 | Corrigan et al | Jan. 24, 1984 |
| 4,038,767 | Chasin et al | Aug. 2, 1977 |
| 3,633,759 | Jennings | Jan. 11, 1972 |
| 3,195,733 | Best | Jul. 20, 1965 |
| 2,964,198 | Eisbart | Dec. 13, 1960 |
| 2,946,454 | Asher | Jul. 26, 1960 |
| 2,879,898 | Best | Mar. 31, 1959 |
| 2,643,774 | Patterson et al | June 30, 1953 |

In the past, numerous display rack arrangements have been disclosed, including the above, to solve such problems of shifting center of gravity with selection of sample-to-be-viewed; ease of removal of samples; unique attachment and detachment devices; and economical construction.

In many of the patents uncovered, various supports, sample hangers, or brackets are provided for the prior art waterfall carpet display devices. Typical is the elongated support member 14 of Ott '974, FIG. 2; the interlocking supporting tray 10 of Jennings '759; the fittings of Best '733 (clamp 25, clamping portion 28 and T-shaped connector 27); the clamping arms 38 and 40 of Eisbart '198, FIG. 3; the clamp 24 of Asher '454, FIGS. 3 and 4; and, the rings 28 and sample support rod 20 of Patterson et al '774, FIGS. 2 and 3. The attachment parts distinguish the sample racks of the prior art in two specific ways, namely; (1) the parts are separable from the rack itself in order to provide the carpet sample support; and, (2) in many cases the samples are not readily detachable from the display rack and are provided to be opened like the pages of a book.

The patents to Corrigan et al '118, Chasen et al '767, and Best '898 all show clamping arrangements wherein mountable carpet samples are clamped to the waterfall display and viewing of the entire sample is accomplished by turning to the particular color or piece selected.

SUMMARY OF THE INVENTION

In general terms this invention describes a carpet sample display device for housing a plurality of carpet samples in a waterfall fashion which device also has the advantages of a pigeonhole sample rack insofar as each sample is individually removable without disturbing adjacent samples. In the particular display rack at hand a sloping frame containing wire rack cells or compartments is mounted on a sled runner type base. The base is constructed of tubular metal. With each carpet sample placed in a compartment the edge portion of each successive sample is displayed by protruding beyond the end of the adjacent carpet sample and thereby providing a "waterfall" display.

The cells or compartments are formed from wire rack portions or components which in turn are connected to bottom support rails that are arrayed on the rectangular frame. While the frame is maintained at a back to front elevation, the wire rack components are substantially horizontal. With the racks disposed horizontally, the samples placed thereon are supported so that somewhat over 50% of the weight of the sample is held by the rack and the balance of the sample is cantilevered beyond the end of the rack portion.

Being of tubular steel construction facilitates the quick knock down and assembly of the display device of this invention and further facilitates the shipment thereof.

OBJECTS AND FEATURES OF THE INVENTION

It is therefore an object of this invention to provide a sample display rack for carpets, which includes means for supporting a plurality of carpet samples—either standard size or half size—in a waterfall arrangement, whereby the edge of the top face of the sample pieces is visible when the rack is loaded.

It is a further object of this invention to provide a sample display rack for carpets, which provides means for removal and replacement of a sample without disrupting the adjacent ones of the carpet samples, thereby allowing each sample piece to be viewed selectively and to be viewed separate from the others on the rack.

It is a still further object of this invention to provide a sample display rack which is stable, yet light in weight, and economical to manufacture.

It is a yet still further object of this invention to provide a sample display rack which is readily knocked down and assembled.

It is a feature of this invention to support carpet samples on a display rack without hangers, attaching hardware, or clamps and to provide a separate compartment for each sample.

It is further a feature of this invention to support carpet samples on a display rack in a manner which minimizes creasing or disturbing of the displayed sample.

It is a still further feature of this invention to be able to knock down the display rack so that it may be readily shipped by conventional carriers.

Other objects and features of this invention will be come apparent from the detailed description and the accompanying drawings.

BRIEF DESCRIPTION OF THE DRAWINGS

In the drawings which follow, the same parts shown on the various views are afforded the same reference numbers.

DESCRIPTION OF THE PREFERRED EMBODIMENTS

Figure 1:
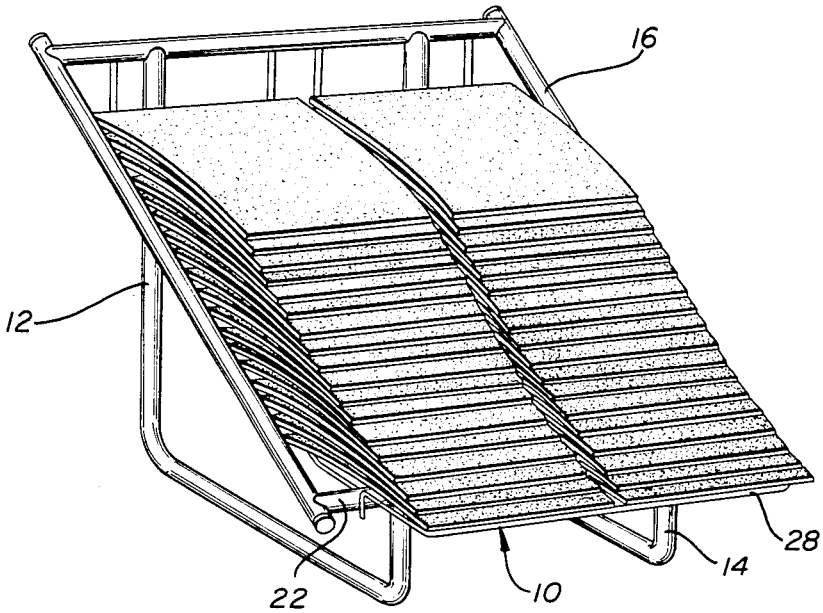
FIG. 1 is a perspective view of the carpet sample display rack of this invention, said rack shown with a split standard sample in each compartment thereof.

In the description which follows, several terms have been used having specific definitions accepted in the industry. The term "standard carpet sample" refers to a sample which measures 27 inches by 18 inches; the term "splits", to samples which measure 13½ inches by 18 inches; the term "pigeonhole sample storage rack," to a storage rack providing separate compartments for each sample or group thereof; and the term "waterfall" to a display rack arranged so that numerous carpet samples have edge portions protruding beyond the adjacent one thereto.

Referring now to FIGS. 1 through 4, there are shown various views of the carpet sample display device which is referred to generally by the numeral 10. The base 12 is structured to include a pair of sled-like supports 14 of tubular metal. While the base is shown in the illustrations as being of this particular sled-like design, those skilled in the art of display rack construction could devise numerous variations thereupon without departing from the spirit hereof. Atop the sled-like supports 14, a rectangular frame assembly 16 is slopingly mounted with screws 18 which attach to captive nuts (not shown) held within the uppermost portions of the supports 14. The frame 16, in turn, has a back frame member 20 and a front frame member 22 and as shown most clearly in FIGS. 2 and 4 the back frame member 20 is structured so as to be substantially elevated above front frame member 22. The frame 16 further includes side frame members 24 and 26. To the central portion of front frame member 22, a front support rail 28 is attached to provide support for the bottommost sample. Rail 28 is mounted so as to be disposed substantially horizontally. (See FIG. 4.) In the best mode of practicing the invention as shown herein, two pairs of bottom support rails 30, 32, 34 and 36 are constructed to interconnect the medial portions of the front and back frame member 20 and 22, respectively. As shown most clearly in FIG. 2 and taking bottom support rail 34 as exemplary for the set, it is seen that the rail 34 has a rear portion 38 which descends vertically from back frame member 20, a middle portion 40 extending forward from the rear portion 38 in a manner parallel to side frame members 24 and 26 and a front portion 42 extending substantially horizontally to the front frame member 22. The front portion 42 and front support rail 28 are dimensioned to support fully the bottommost carpet sample as described in more detail hereinbelow.

Figure 4:
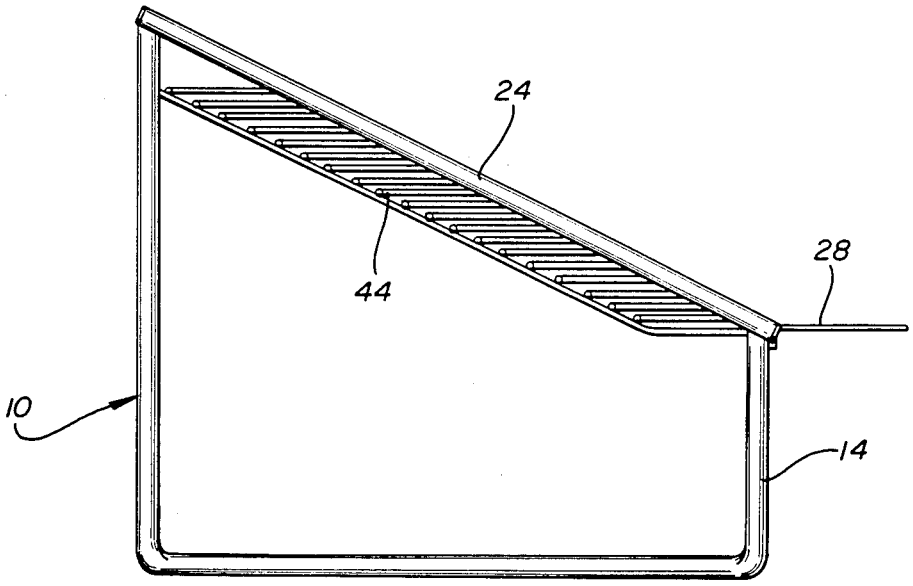
Figure 2:
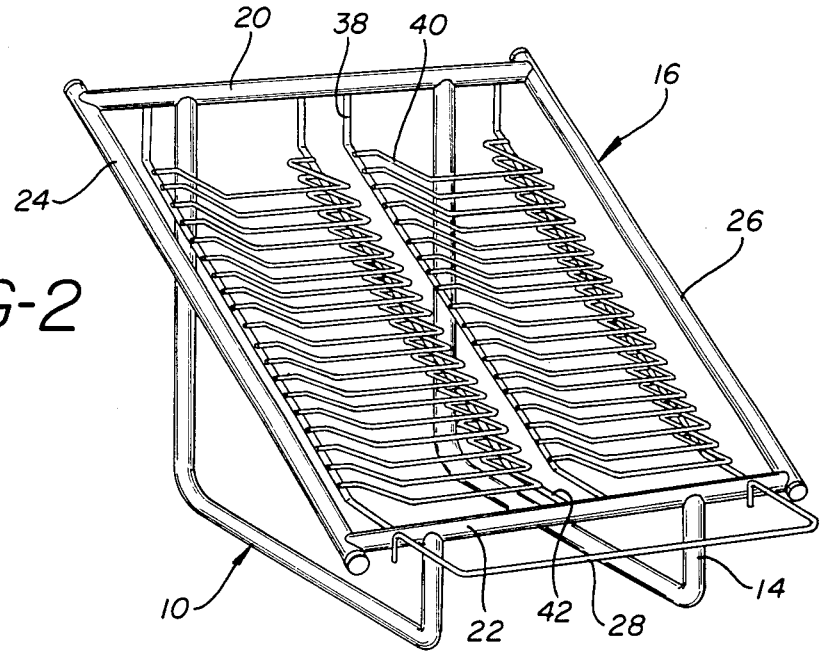
FIG 2 is a perspective view of the carpet sample display rack of FIG. 1, but shown without the carpet samples in place.
Figure 3:
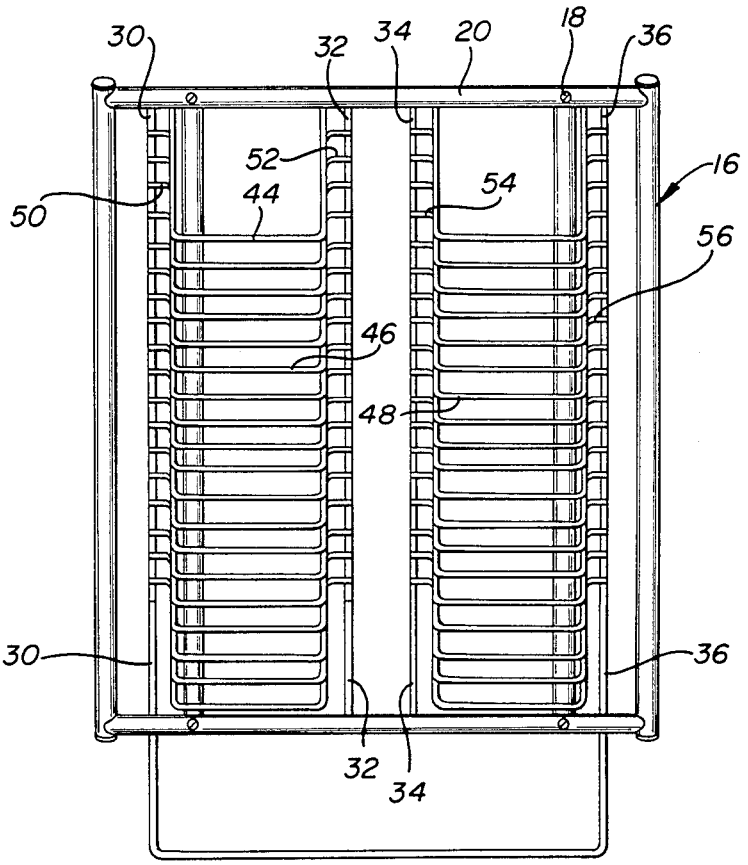
FIG. 3 is a top elevational view of the carpet sample display rack of FIG. 2 and shows in detail the frame, the support rails, and the wire racks; and, FIG. 4 is a side elevational view of the carpet sample display each of FIG. 2 and shows in detail

Referring now to FIGS. 2, 3, and 4, the compartments or carpet sample racks 44 are now described. The rack 10 includes separate wire rack arrangements for each standard carpet sample or for each split sample. Although in the best mode of practicing the present invention, wire racks or shelves are employed, the carpet sample display rack of this invention can also be constructed with wood or Masonite® shelving. Thus, the disclosed invention hereof is constructed to have the sample handling capability of pigeonhole sample storage rack and the display attributes of a waterfall carpet sample display rack. In forming the compartments 44, a first series of U-shaped wire rack portions 46 are mounted substantially horizontally to bottom support rails 30 and 32 and a corresponding second series of U-shaped wire rack portions 48 are mounted substantially horizontally to bottom support rails 34 and 36. The compartments are constructed to support a split sample in each opening. The series of racks 46 and 48 are spaced so that adjacent side-by-side compartments are open to each other and any adjacent two splits may be replaced by a single standard carpet sample. Each of the wire racks 46 are constructed, so that the open ends 50 and 52 of the "u" attach to bottom support rails 30 and 32 respectively. Similarly each of the wire racks 48 are constructed so that the open ends 54 and 56 of the "U" attach to bottom support rails 34 and 36 respectively. In constructing the cells or compartments in this manner, the racks are dimensioned so that over 50% of the weight is supported by the rack portion and the balance is cantilevered beyond the rack portion.

Referring now to FIG. 1 the operation of the carpet sample display rack is discussed. The frame 16 with the sample racks 44 attached thereto is first mounted to the sled like supports 14 with attached hardware 18. Then front support rail 28 is installed to front frame member 22 so as to extend forward and horizontally therefrom. The carpet samples are accommodated with the bottommost sample being fully supported by front support rail 28 and front portion 42 of the bottom support rail. Thereafter successively higher and rearward samples are installed in each cell with each sample having somewhat over 50% of its weight supported by the compartment and the balance thereof being cantilevered beyond the edge of the wire rack cell.

Although the best mode of the invention has been described herein in some detail, it has not been possible to include each and every variation. Those skilled in the art of carpet sample display racks will be able to make slight variations in the materials or mechanical arrangement suggested hereby without departing from the spirit of the invention and still be within the scope of the claims appended hereto.

What is claimed is:

1. A display device for a plurality of carpet samples comprising:

a base;

a rectangular frame slopingly mounted in the top portion of said base, said frame having a back frame member, a front frame member, and a pair of side frame members, said back frame member when assembled thereto, being elevated substantially above said front frame member;

a plurality of bottom support rails interconnecting the medial portions of said front and said back frame members said bottom support rails having a rear portion descending substantially vertically from said back frame member, having a middle portion disposed substantially parallel to said side frame members, and having a front portion extending substantially horizontally to said front frame member; and, a plurality of sample-holding compartments mounted thereon, each said compartment forming a pigeonhole for one of said carpet samples with said samples being arrayed in a waterfall display;

whereby each carpet sample in one of said compartments has a displayed edge portion which protrudes beyond the end of the adjacent carpet sample in the adjacent rearward compartment.

2. A display device for a plurality of carpet samples as described in claim 1 further comprising:

front support rail means attached to the central portion of said front frame member for partially supporting the bottommost sample arrayed on said display device, said front support rail means being substantially horizontal;

whereby said bottommost sample is fully supported by said frame and said front support rail means.

3. A display device for a plurality of carpet samples as described in claim 1, further comprising:

front support rail means attached to the central portion of said front frame member for partially supporting the bottommost sample arrayed on said display device, said front support rail means being substantially horizontal.

4. A carpet sample display device comprising:

a base;

a rectangular frame slopingly mounted on said base, said frame having a back frame member, a front frame member, and a pair of side frame members, said back frame member, when assembled to said base, being elevated substantially above said front frame member;

a plurality of bottom support rails interconnecting the medial portions of said front and said back frame members said bottom support rails having a rear portion, descending substantially vertically from said back frame member, having a middle portion disposed substantially parallel to said side frame members, and having a front portion extending substantially horizontally to said front frame member.

a plurality of wire racks substantially horizontally disposed and attached at the portion thereof adjacent said back frame member to at least one of said bottom support rails; and, each said wire rack dimensioned to support one of said carpet samples placed thereon and to support substantially more than one half the weight thereof with the unsupported portion extending in a cantilevered manner beyond said wire rack;

whereby a waterfall display of carpet samples is formed as each successively higher wire rack is mounted rearward of the adjacent lower one thereof.

5. A carpet sample display device as described in claim 4 further comprising: front support rail means attached to the central portion of said front frame member for partially supporting the bottommost sample arrayed on said display device, said front support rail means being substantially horizontal;

whereby said bottommost sample is fully supported by said frame and said front support rail means.

6. A carpet sample display device as described in claim 5 wherein said base includes a pair of tubular metal sled-like runners.

7. A carpet sample display device as described in claim 6 wherein said base further comprises:

attachment means for quick erecting and disassembling of said runners from said frame.

8. A carpet sample display device as described in claim 7 wherein each said U-shaped wire rack portion is further dimensioned to permit the removal of a carpet sample stored thereon without removing any adjacently stored carpet samples.

9. A display device for a plurality of carpet samples comprising:

a base having a pair of tubular metal sled-like runners;

a rectangular frame slopingly mounted in the top portion of said base, said frame having a back frame member, a front frame member, and a pair of side frame members, said back frame member when assembled thereto, being elevated substantially above said front frame member, a plurality of bottom support rails interconnecting the medial portions of said front and said back frame members said bottom support rails having a rear portion descending substantially vertically from said back frame member, having a middle portion disposed substantially parallel to said side frame members, and having a front portion extending substantially horizontally to said front frame member; and, a plurality of sample-holding compartments mounted thereon, each said compartment forming a pigeonhole for one of said carpet samples with said samples being arrayed in a waterfall display;

whereby each carpet sample in one of said compartments has a displayed edge portion which protrudes beyond the end of the adjacent carpet sample in the adjacent rearward compartment.

10. A display device for a plurality of carpet samples as described in claim 9, wherein said base further comprises:

attachment means for quick erecting and disassembling of said runners from said frame.

11. A display device for a plurality of carpet samples as described in claim 10, wherein each of said sample-holding compartments includes a U-shaped wire rack portion being affixed to said bottom support rail means and dimensioned to support one of said carpet samples placed thereon.

12. A display device for a plurality of carpet samples as described in claim 11, wherein each of said wire rack compartments is further dimensioned to support substantially more than one half the weight of each carpet sample with the unsupported portion thereof extending in a cantilevered manner beyond said compartment.

13. A display device for a plurality of carpet samples as described in claim 12, wherein each said U-shaped wire rack portion is further dimensioned to permit the removal of a carpet sample stored thereon without removing any adjacently stored carpet samples.

* * * * *